US008475302B1

(12) United States Patent
Hummel, III

(10) Patent No.: US 8,475,302 B1
(45) Date of Patent: Jul. 2, 2013

(54) BROAD TAIL HUNTING ARROW

(76) Inventor: George A Hummel, III, Port Trevorton, PA (US)

( * ) Notice: Subject to any disclaimer, the term of this patent is extended or adjusted under 35 U.S.C. 154(b) by 0 days.

(21) Appl. No.: 13/317,420

(22) Filed: Oct. 18, 2011

(51) Int. Cl.
*F42B 6/04* (2006.01)

(52) U.S. Cl.
USPC ..... 473/578; 473/586

(58) Field of Classification Search
USPC ..... 473/583, 584, 585, 586
See application file for complete search history.

(56) References Cited

U.S. PATENT DOCUMENTS

| | | | | | |
|---|---|---|---|---|---|
| 2,628,837 | A * | 2/1953 | Zwickey | ..... | 473/585 |
| 3,084,939 | A * | 4/1963 | Zwickey | ..... | 473/585 |
| 4,615,529 | A * | 10/1986 | Vocal | ..... | 473/583 |
| 5,427,384 | A * | 6/1995 | Saunders | ..... | 473/578 |
| 5,472,213 | A * | 12/1995 | Dudley | ..... | 473/583 |
| 6,217,467 | B1 * | 4/2001 | Maleski | ..... | 473/583 |
| 7,909,714 | B2 * | 3/2011 | Cyr et al. | ..... | 473/578 |

* cited by examiner

*Primary Examiner* — John Ricci
(74) *Attorney, Agent, or Firm* — Richard K. Thomson

(57) ABSTRACT

A hunting arrow has a wound-enhancing accessory which has at least one pair of pivoting knife blades which deploy upon striking the targeted prey. Unlike existing broad head devices, the blades of the present invention are positioned at the tail of the arrow between the fletching and the nock where there is less impact on the aerodynamics of the arrow. In one embodiment, the restraining force resisting deployment of the knife blades can be adjusted using a set screw.

8 Claims, 3 Drawing Sheets

BROAD TAIL HUNTING ARROW

BACKGROUND AND SUMMARY OF THE INVENTION

The present invention is directed to the field of hunting. More particularly, the present invention is directed to a hunting arrow which features an accessory insertable between the nock and the fletching which has deployable cutting blades to ensure a kill through bleed out.

The previously developed broad head arrows feature cutting elements which are positioned at the front end of the arrow. In this position, the added weight and wind resistance greatly affect the flight of the arrow and reduce the probability of hitting the prey at all, let alone in an area where it can afford maximum damage, i.e., guarantee downing the game animal being hunted. By positioning the "broadtail" (as contrasted to the broad head of the prior art) near the rear of the arrow, directly between the shaft and the nock, the flight of the arrow is much less affected by the added weight, benefits from the stabilizing effects of the fletching resulting in a truer flight and enhanced prospects of a kill.

The present invention comprises a hunting arrow adapted for hunting a prey including seriatim: a) a tip; b) a shaft having a longitudinal axis; c) fletching symmetrically positioned about that axis; d) a broadtail accessory with deployable knife blades for enlarging a wound in the prey to ensure a kill; e) a nock member for engaging a string of a bow. Preferably the broadtail accessory includes at least a pair of knife blades biased to a forward position. The blades deploy to an aft lock position upon a forward edge of the knife blades contacting an outer skin of the prey as the broadtail accessory enters the wound. One embodiment includes adjustment means to vary a biasing force exerted on the at least one pair of knife blades. It will be understood that the present invention can be sold as an accessory adapted for insertion in a hunting arrow between the fletching and string engaging nock.

Various other features, advantages, and characteristics of the present invention will become apparent after a reading of the following detailed description.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF THE PREFERRED EMBODIMENT(S)

Figure 1:
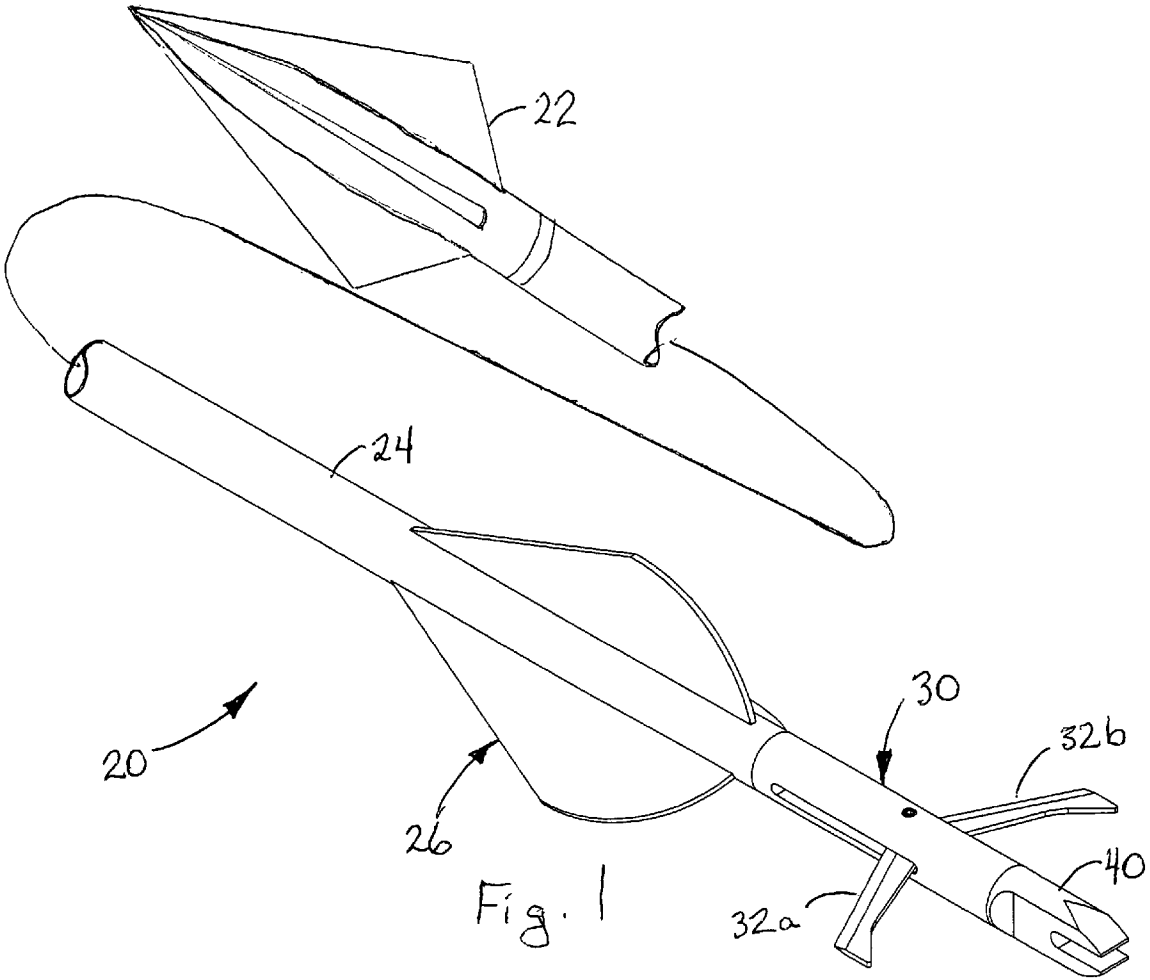
FIG. 1 is a front perspective view of a first embodiment of the broadtail hunting arrow of the present invention.
Figure 2:
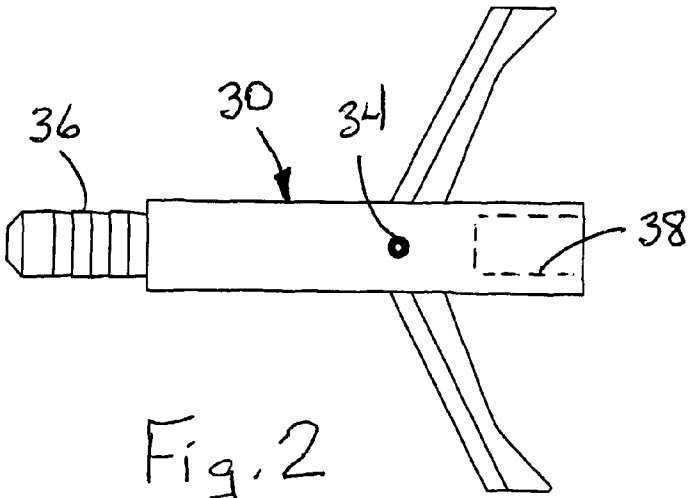
FIG. 2 is a top view of the broadtail accessory used in the first embodiment.
Figure 3:
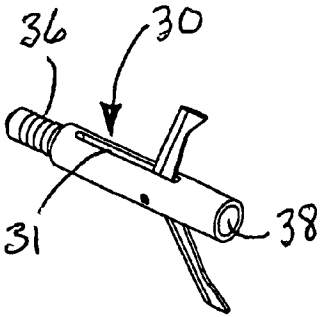
FIG. 3 is a bottom perspective view of the broadtail accessory used in the first embodiment; and, FIG. 4 is a top view of a second embodiment of the broadtail accessory of the present invention.

A first embodiment of the broadtail hunting arrow, the first aspect of the present invention, is depicted in FIGS. 1-3 generally at 20. The broadtail arrow of the present invention comprises, assembled seriatim (sequentially) tip 22, interconnected to shaft 24 which has a longitudinal axis A, fletching 26 symmetrically positioned about axis A, a broadtail accessory 30 with deployable knife blades 32*a*, 32*b* for enlarging a wound in a prey to ensure a kill, and nock 40 for engaging a bow string. It will be appreciated that although accessory 30 has been depicted as having on pair of knife blades 32*a*, 32*b*, it is within the scope of invention to employ two pair oriented in orthogonal planes.

The details of the first embodiment of accessory 30 are depicted in FIGS. 2 and 3. Knife blades 32*a*, 32*b* are mounted in through slot 31 by, and pivot about, set screw 34. Accessory 30 is equipped with a friction fitting 36 for receipt into a recess formed in the aft end of shaft 24 and has a similar recess 38 to permit the friction fit of nock 40. In this embodiment, knife blades 32*a*, 32*b* may be retained in the closed, undeployed position in a manner consistent with existing broad head arrows, an elastic band, for example.

Figure 4:
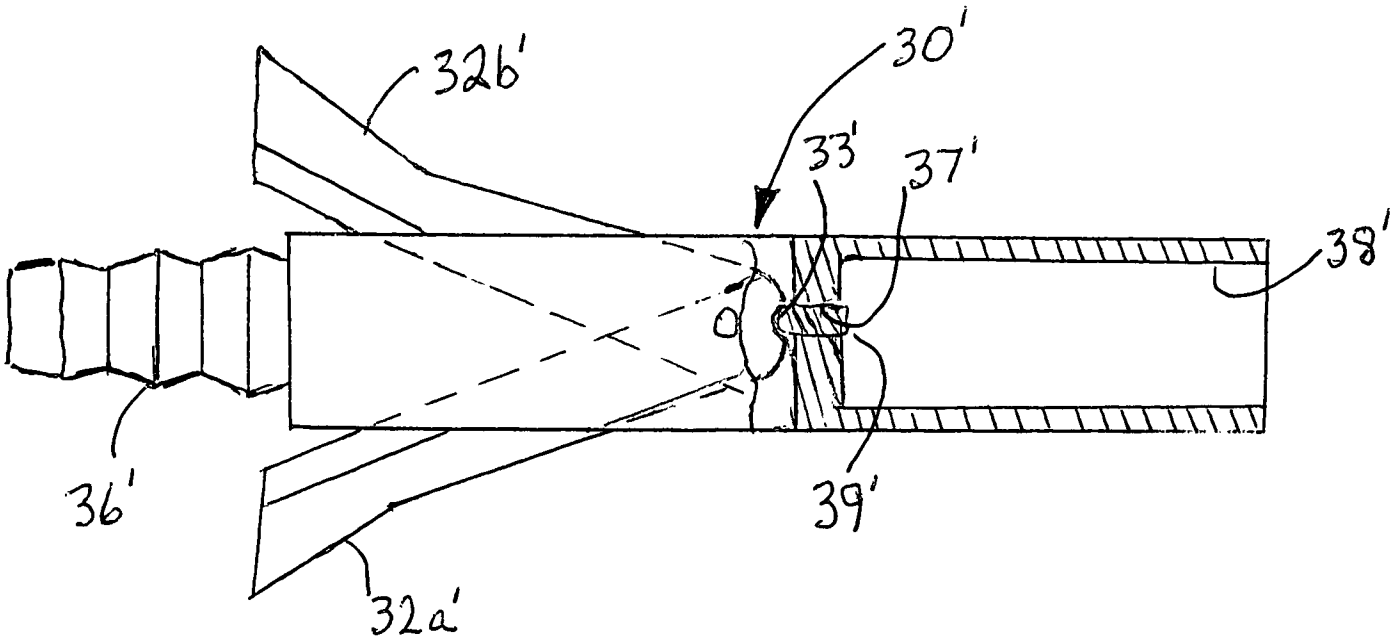

A second embodiment of the broad tail accessory of the present invention is depicted in FIG. 4 generally at 20'. This second embodiment is like the first in all particulars with the following noted exceptions. In the aft end of each of the blades 32*a*' and 32*b*' a small dimple or indentation 33' is formed. The cavity formed by recess 38' is deeper than its counterpart in the first embodiment and a threaded bore 37' is formed extending from recess 38' into through slot 31'. By adjusting the set screw 39' in threaded bore 37', the amount of force needed to deploy knife blades 32*a*' and 32*b*' from the in-flight position depicted in FIG. 4 to the extended position shown in FIG. 1, can be adjusted. It will be appreciated that while the adjustment feature has been disclosed in connection with the broad tail accessory 20' of the present invention, it will have equally effective application in a conventional broad head arrow, as well.

Various changes, alternatives, and modifications will become apparent to a person of ordinary skill in the art after a reading of the foregoing specification. It is intended that all such changes, alternatives, and modifications as fall within the scope of the appended claims be considered part of the present invention.

I claim:

1. A hunting arrow adapted for hunting a prey, said arrow comprising elements interconnected seriatim:

a) a tip;

b) a shaft having a longitudinal axis;

c) fletching symmetrically positioned about said axis;

d) a broadtail accessory with deployable knife blades for enlarging a wound in the prey to ensure a kill;

e) a nock member for engaging a string of a bow.

2. The hunting arrow of claim 1 wherein said broadtail accessory includes at least one pair of knife blades biased to a forward position.

3. The hunting arrow of claim 2 wherein said at least one pair of knife blades deploy to an aft lock position upon a forward edge of each of said knife blades contacting an outer skin of the prey as said broadtail accessory enters the wound.

4. The hunting arrow of claim 2 further comprising adjustment means to vary a biasing force exerted on said at least one pair of knife blades.

5. A broadtail accessory for a hunting arrow, said accessory comprising a cylindrical body portion adapted to be inserted in an arrow behind fletching and ahead of a nock member, said accessory including at least a pair of knife blades biased to a forward position each extending out of a slot in said cylindrical body portion and adapted to rotate outwardly and rearwardly to an extended locked position as said accessory follows said fletching into a wound in a designated prey including adjustment means to vary a biasing force exerted on said at least a pair of knife blades.

6. In an accessory for a hunting arrow employing a set of deployable knife blades which pivot from a first in-flight position to a second extended position useful for enlarging a wound in the prey to ensure a kill, the improvement comprising a) an indentation formed on an aft end of at least one knife blade;

b) a threaded bore extending from a nock-receiving aperture in a trailing end of said accessory and a through slot extending laterally through a length of said accessory, said through slot receiving said deployable knife blades;

c) a set screw adjustably received in said threaded bore, set screw engaging in at least one said indentation of each said knife blade;

whereby a position of said set screw can be adjusted to vary an amount of force necessary to deploy said knife blades from said in-flight position to said extended position.

7. The improvement of claim 6, wherein each knife blade has an indentation formed in an aft end thereof.

8. The improvement of claim 7 wherein said set screw engages each said indentation formed in said aft end of each said knife blade.

* * * * *